US007281844B2

(12) United States Patent
Glanville

(10) Patent No.: US 7,281,844 B2
(45) Date of Patent: Oct. 16, 2007

(54) VARIABLE STATIC MIXER

(76) Inventor: Robert W Glanville, 16 Peckham Dr., Bristol, RI (US) 02806

( * ) Notice: Subject to any disclaimer, the term of this patent is extended or adjusted under 35 U.S.C. 154(b) by 227 days.

(21) Appl. No.: 11/146,619

(22) Filed: Jun. 6, 2005

(65) Prior Publication Data

US 2006/0268660 A1 Nov. 30, 2006

Related U.S. Application Data

(60) Provisional application No. 60/577,719, filed on Jun. 7, 2004.

(51) Int. Cl.
*B01F 5/06* (2006.01)

(52) U.S. Cl. ..... 366/340; 366/176.2; 138/46

(58) Field of Classification Search ..... 366/176.2, 366/181.5, 336–340; 138/45–46
See application file for complete search history.

(56) References Cited

U.S. PATENT DOCUMENTS 3,880,191 A * 4/1975 Baumann ..... 137/625.32
4,487,510 A * 12/1984 Buurman et al. ..... 366/337
5,556,200 A * 9/1996 Ekholm et al. ..... 366/175.2
5,839,828 A * 11/1998 Glanville ..... 366/340
5,947,157 A * 9/1999 Kindersley ..... 138/45
5,967,658 A * 10/1999 Mohajer ..... 366/337
6,048,089 A * 4/2000 Andrews et al. ..... 366/151.1
6,623,155 B1 * 9/2003 Baron ..... 366/181.5
2006/0268660 A1 * 11/2006 Glanville ..... 366/340

FOREIGN PATENT DOCUMENTS

EP 1166862 A1 * 1/2002
EP 1514592 A1 * 3/2005

* cited by examiner

*Primary Examiner*—Charles E. Cooley
(74) *Attorney, Agent, or Firm*—Robert J. Doherty

(57) ABSTRACT

A variable static mixer and system for accommodating variable and different flows in a pipeline so as to produce maximum mixing efficiency including a first mixer mounted in the pipeline and a second mixer mounted in the pipeline at a downstream location wherein the second mixer has a plate with a mixing orifice which plate is adapted to move between non-mixing and mixing positions.

7 Claims, 7 Drawing Sheets

VARIABLE STATIC MIXER

This application claims the benefit of U.S. Provisional Patent Application No. 60/577,719 filed Jun. 7, 2004.

BACKGROUND OF THE INVENTION

This invention relates to mixing devices commonly referred to as static mixers. Generally such mixers are disc-like in shape and include a plate having a central opening or orifice of various fixed geometric configurations and mounted in a pipe through which fluid passes so as to create a turbulent mixing action to the fluid such that other materials introduced into the stream generally via injection nozzles located downstream and generally adjacent the plate are uniformly mixed with the fluid.

As indicated, standard static mixers have a fixed geometry, which means that the headloss is a direct function of the velocity of the fluid in the pipeline. Generally speaking, a mixer designed for low (1-3 FPS) velocity will generate excessive headloss at high pipeline velocity (8-12 FPS). Conversely, a mixer designed for reasonable mixing and headloss at high velocity generally will not provide good mixing at low velocity.

To date, this problem has been addressed by making separate mixers with mixing characteristics suited for particular pipeline velocities. For instance, the present applicant commercially supplies three separate mixers with different orifice diameters or beta ratios (beta ratio=orifice diameter/pipe inside diameter) of 0.7, 0.8 and 0.9. See FIG. 9 for further beta information. This enables a user to choose a mixer that gives good mixing performance at high, medium or low pipeline fluid velocities respectively, but no one mixer achieves good performance at all of these different velocities.

It is therefore an object of the present invention to provide a mixer and mixing system that can be adjusted to achieve good mixing performance at differing pipeline velocities without the need of removing one mixer and substituting another mixer in the pipeline.

These and other objects of the invention are accomplished by the provision of a static mixer of the type having a generally centrally disposed orifice disposed within a generally flat plate adapted for mounting within a pipe such that the plate is adjustably movable to various alternate operable positions between a first essentially non-mixing position wherein the plate edge is disposed in line with the fluid flow within the pipe to a fully mixing position wherein the plate face is disposed normal to the fluid flow within the pipe.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 7:
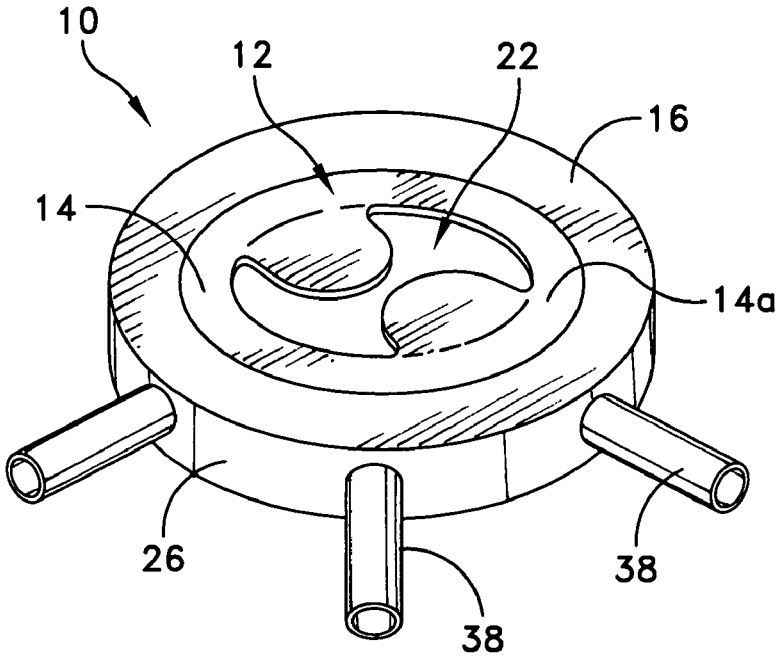
FIG. 7 (PRIOR ART)
FIG. 7 is a perspective view of a fixed mixer device disposed within a pipe and viewed from the upstream direction.
Figure 8:
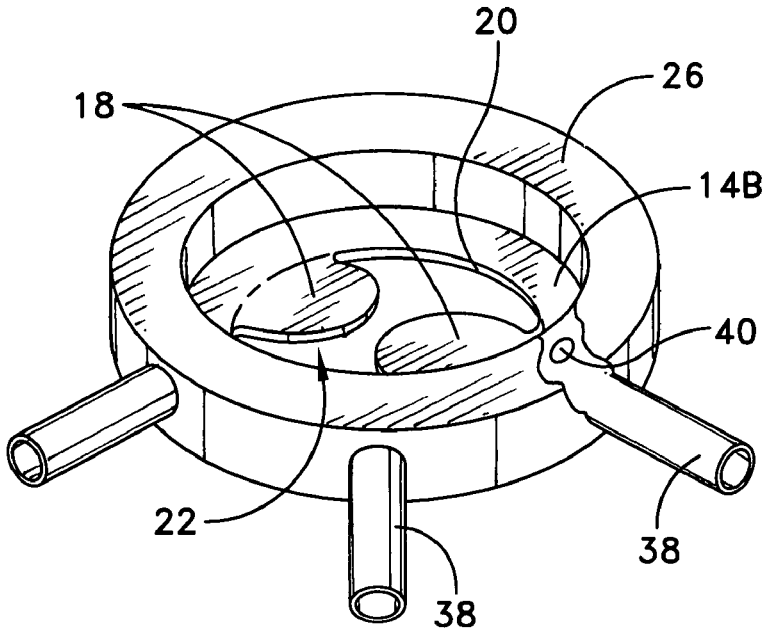
FIG. 8 (PRIOR ART)
FIG. 8 is a view similar to FIG. 7 but viewed from the downstream position.
Figure 9:
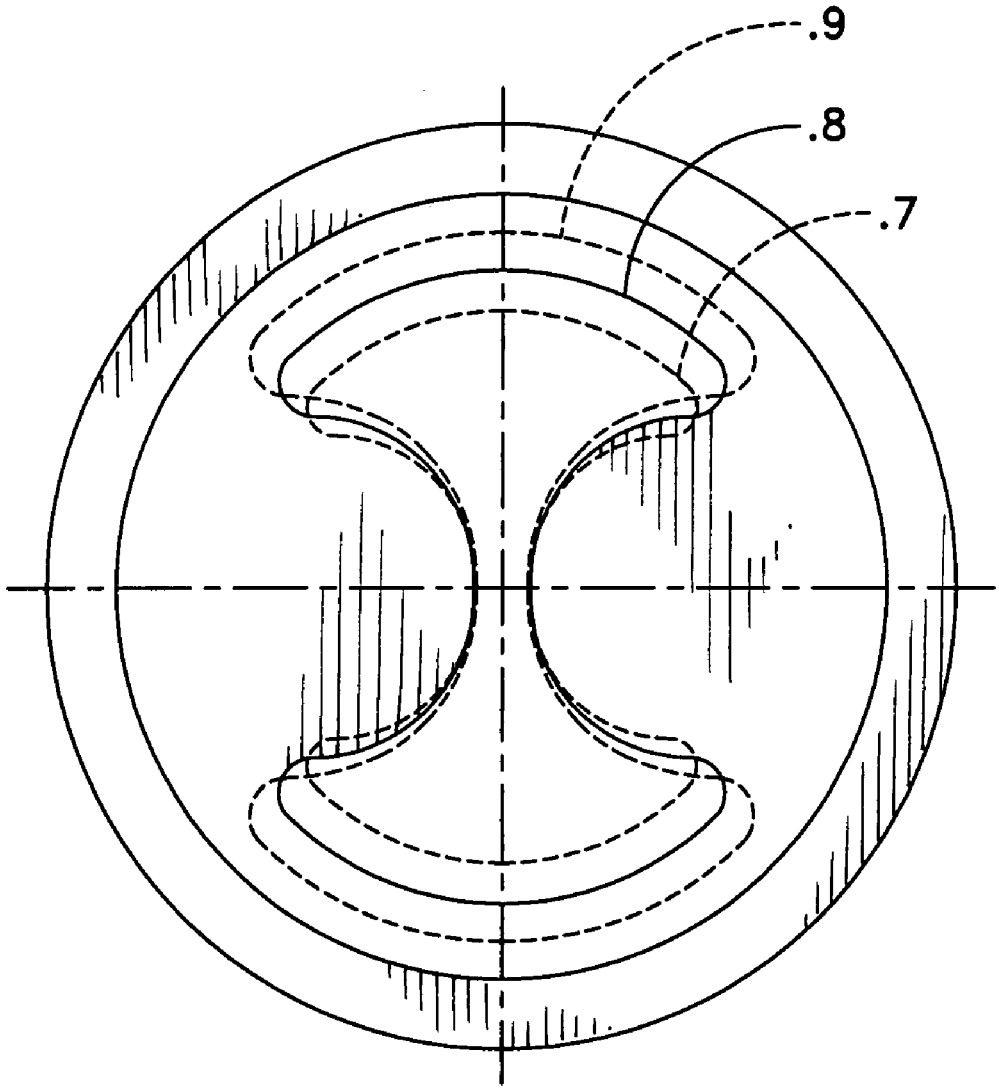
FIG. 9 (PRIOR ART)
FIG. 9 is an illustrative explanation of the term "beta" as applied herein.

Turning now to the drawings and particularly FIGS. 7 and 8 thereof, a typical static mixer is depicted. The device 10 is of an overall circular outside configuration, that is, a disc-like body 12 including an outside flange portion 14 extending inwardly from the outer periphery 16 of the disc 12 approximately one third of the radius of the entire disc 12 and a pair of radially opposed flaps 18 inwardly extending from the inner periphery 20 of such flange towards each other but not touching so as to form, in essence, a central open area 22 of a dumbbell-type configuration. The flange 14 includes flat opposed upstream and downstream surfaces 14*a* and 14*b* which project into the fluid stream, that is, portions of the fluid stream (generally the portions closer to the pipe wall) contact and, in effect, are diverted by surface 14*a* prior to passing through the central open area formed by the inner peripheral surface 20. In addition, the flaps 18 are bent downwardly inwardly towards the flow direction of the fluid through the pipe 24 in which the device 10 is mounted. Such mounting of the device 10 in the pipe 24 is accommodated by an outer plate 26 of cylindrical configuration and including a radially outwardly extending step 28 on the upstream side thereof such that the periphery 16 of the disc body may contact such step 28 and be held within the confines of the pipe 24 thereby. Pipe collars 30 may be provided at opposed ends of the pipe 24 to accommodate the insertion of the plate 26 therebetween and affixation thereto by bolts or other conventional means (not shown) passing through the plate and collars 26, 30 respectively.

It will also be apparent from this and other drawings that the flaps preferably 18 as well as the flange 14 extend inwardly into the fluid flow and that additionally the flaps extend at an angular relationship to such internal pipe or wall surface of approximately 15 degrees in the downstream direction but could even extend at angles of 25 or to 40 degrees. Preferably, the configuration of the flaps 18 is semi-elliptical or semicircular such that defined open area 22 is entirely made up of rounded boundaries, that is, the areas where the flaps 18 meet the internal periphery 20 of the flange 14 are rounded.

It should be stated that the particular static mixer configuration above described is that of applicant's issued U.S. Pat. No. 5,839,828 that is hereby incorporated into the present Specification by specific reference thereto. It should also be stated that other static mixers of the same general type could also be utilized in the present invention, e.g., those mixers shown in FIGS. 12 and 13 of U.S. Pat. No. 6,595,682.

The present invention utilizes the above-described static mixers by installing a first mixer in a fixed position in an upstream location. Such first mixer is adapted to provide good mixing at high fluid velocities. In addition or in lieu thereof as will be discussed hereinafter, a second but variable position static mixer is installed downstream therefrom. The second mixer is dimensioned to provide efficient mixing for low fluid velocities and when coupled with the first mixer in the subject system can provide efficient mixing over a wide range of fluid velocities unachievable with systems incorporating only one of the static mixers in a fixed position.

Specifically with respect to the particular static mixers that applicant produces, applicant installed a conventional 0.9 beta mixer with standard chemical injection nozzles downstream of one or both trailing tabs. A second movable 0.7 beta ratio mixer is installed two pipe diameters downstream from the first fixed mixer. The second mixer is designed to pivot 90 degrees on its vertical axis (same as a disc in a butterfly valve). The rotary position of this second mixer is controlled either by an externally mounted operating lever or by a standard electric butterfly valve operator (gear motor) hereinafter referred to as means for pivoting mixer plate (see FIG. 6).

Figure 6:
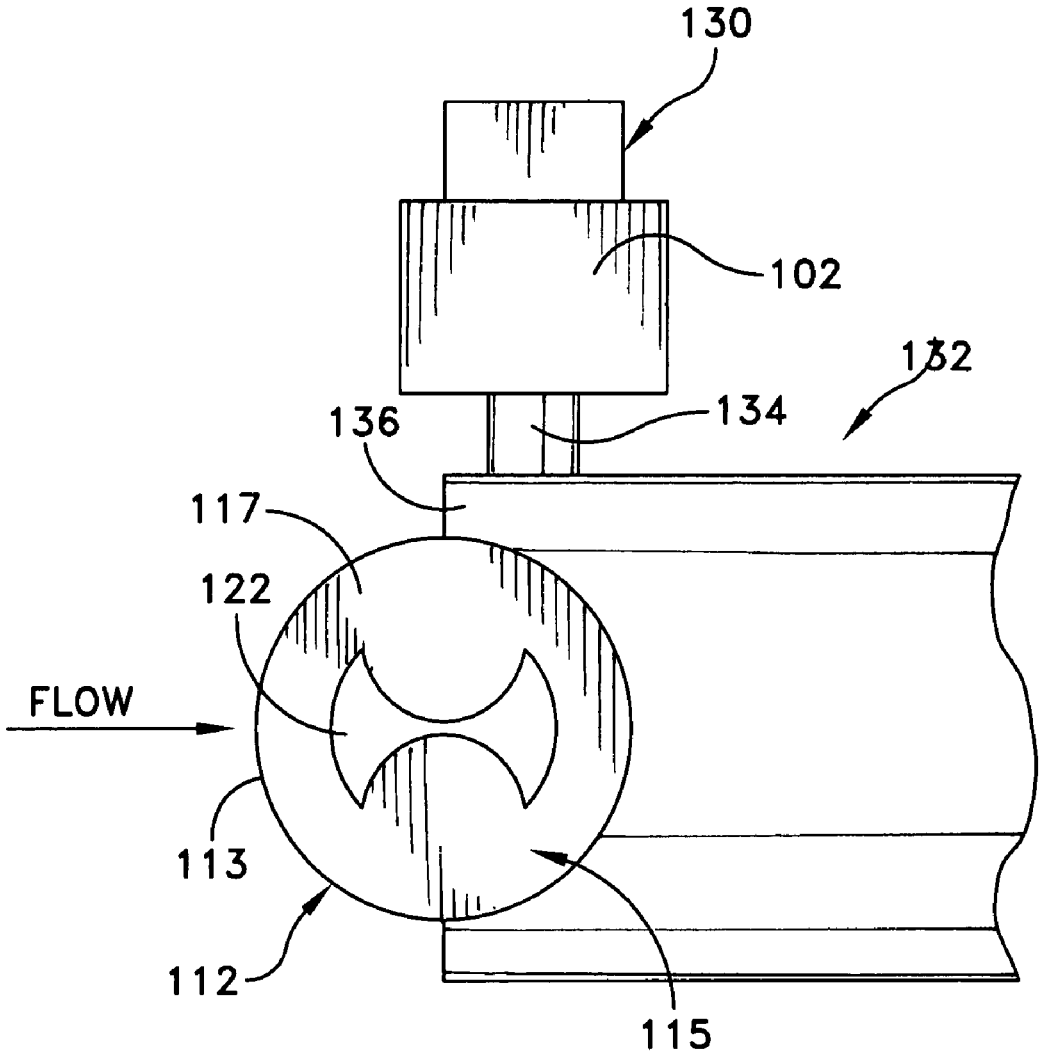
FIG. 6 is an elevational view of the variable position mixer of the present invention positioned within a pipeline in its first essentially non-mixing position.

In operation at high velocities, the first 0.9 beta mixer provides good mixing and low headloss. The second 0.7 beta mixer is rotated so that the disc is parallel to the direction of flow thus providing very little additional headloss and mixing. This fully open (pivoted 90 degrees) position of the second mixer plate is shown in FIG. 6. As the pipeline velocity decreases, the second mixer (the 0.7 beta mixer) is progressively rotated closed (right angles to the direction of flow). Thus at very low pipeline velocity (3-8 FPS), the second 0.7 beta mixer would be completely closed thus providing a 0.9 beta mixer followed by the 0.7 beta mixer.

The variable static mixer system above described provides excellent mixing and minimal headloss for all pipe velocities.

The position of the movable second mixer could be automatically controlled to provide constant headloss over a range of velocities.

Figure 1:
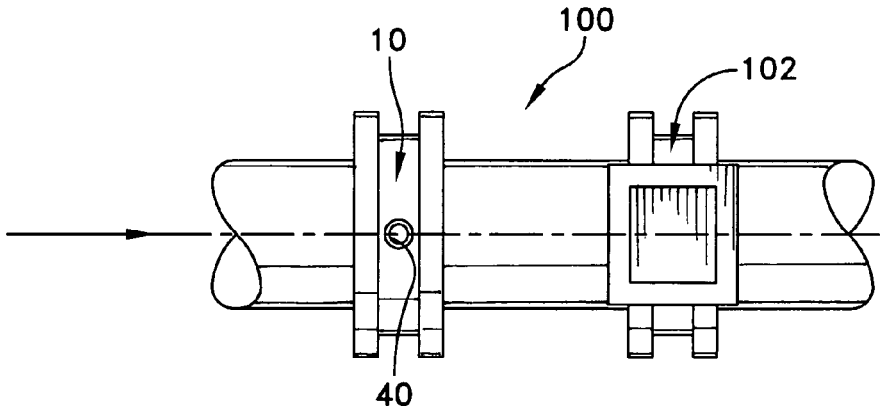
FIG. 1 is a top view of a pipe section including the static mixer system of the present invention installed therein.
Figure 2:
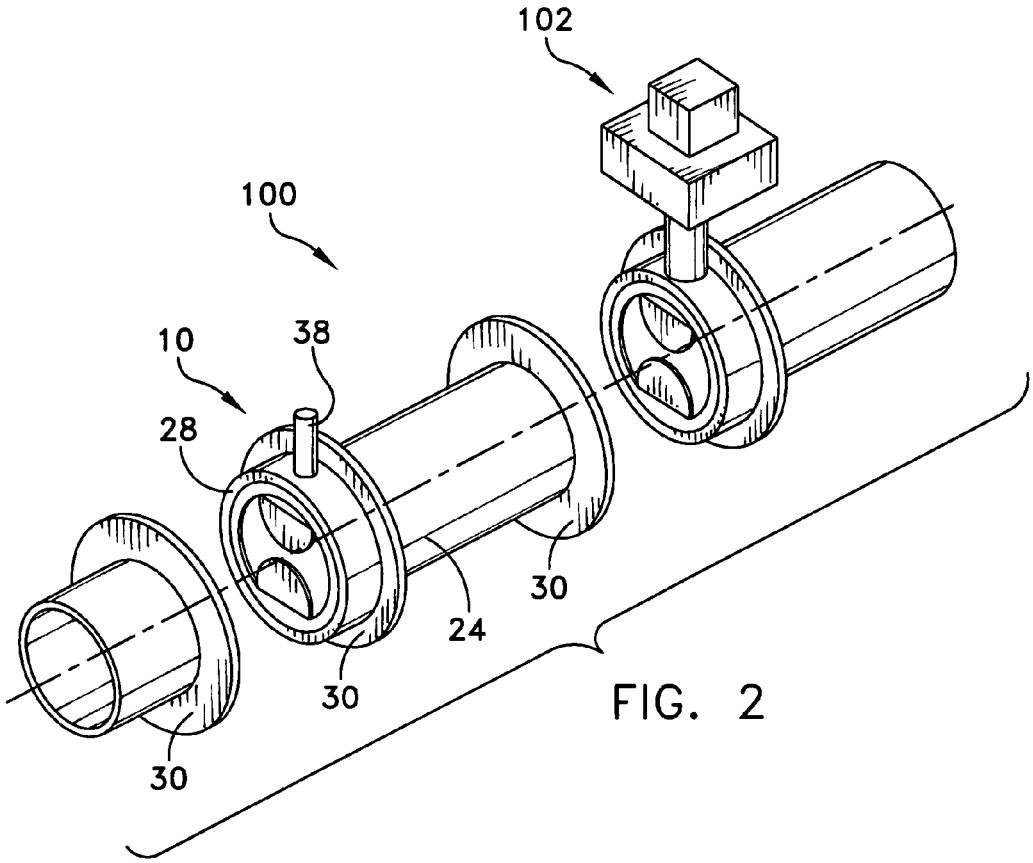
FIG. 2 is an exploded perspective view of FIG. 1.
Figure 3:
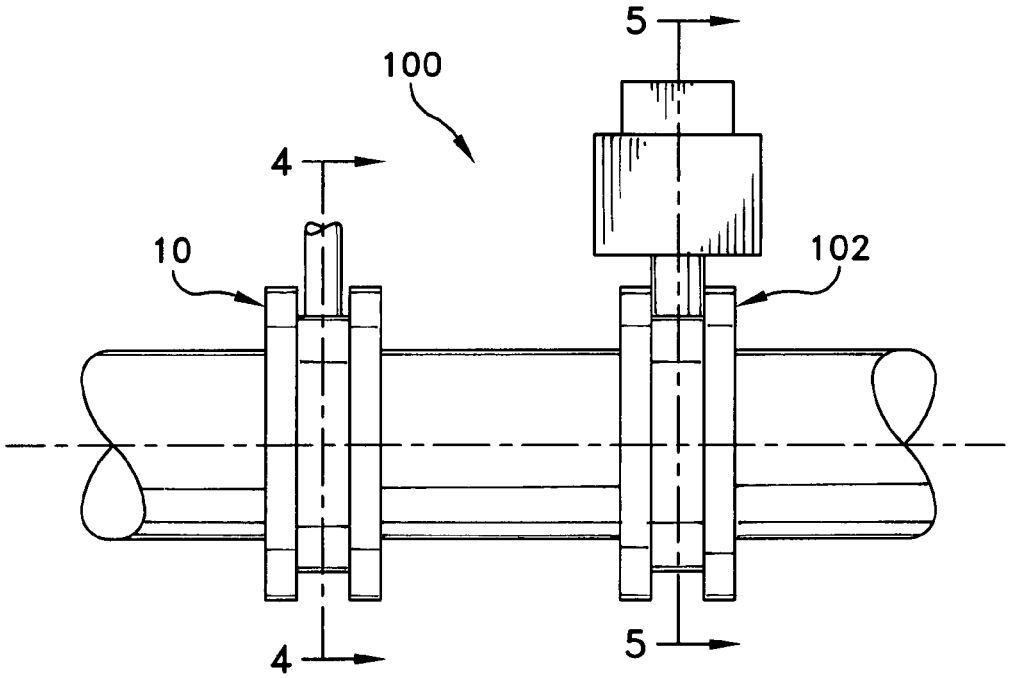
FIG. 3 is a side elevational view of FIG. 1.
Figure 4:
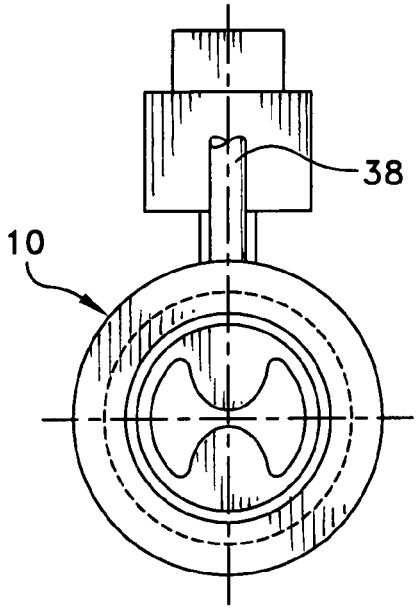
FIG. 4 is a stylized sectional view along line 4-4 of FIG. 3.

The shape of each of the mixer plates may be that of the plates described in U.S. Pat. No. 5,839,828 issued to the present applicant, Robert W. Glanville, Nov. 24, 1998 and which is hereby incorporated into the present application by specific reference thereto. It should be noted that by the phrase "designed to pivot 90 degrees" means that the second mixer plate is adapted to rotate on its vertical axis from a fully mixing position or closed position as shown in FIGS. 2 and 5 to an essentially non-mixing or fully open position as shown in FIG. 6 and that the second mixer plate could, of course, encompass slightly less or much greater rotational angles so long as the above described mixing modes as well as intermediate mixing modes are accomplished.

With reference to FIGS. 1-5, additive material is introduced into the system 100 shown therein in conjunction with the first mixer 10. As is known in the art, additive materials are injected through pipes or quills 38 that lead to injection ports 40 in the plates 26 on the downstream side of the mixer. The turbulence created by fluid passing through the orifice or central open area 22, in effect, draws in the additive material to accomplish at least partial mixing thereof within the fluid stream. The particular system shown in the drawings utilizes a fixed static mixer 10 having a beta of 0.9 that provides good mixing at high velocities. However in order to obtain better improved and more flexible operation and mixing efficiencies at medium and lower fluid velocities, a second and movable static mixer 102 with a lower beta, e.g., 0.7, is positioned in the pipe downstream from the first mixer 10. A separation distance of two pipe diameters was utilized with the effective results as indicated above. It is believed that such separation distance of at least two pipe diameters should be maintained for mixing efficiency and physical placement.

Figure 5:
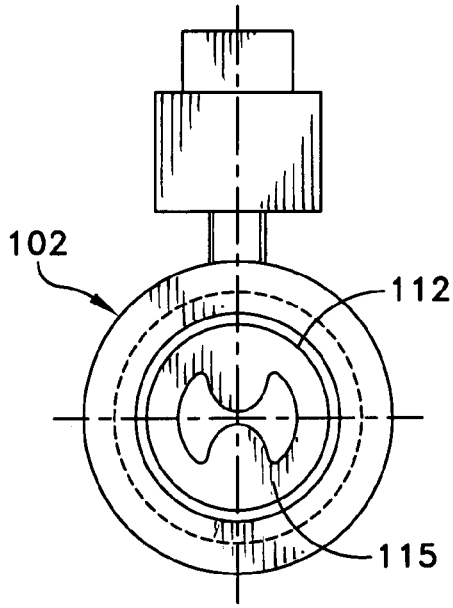
FIG. 5 is a stylized sectional view along line 5-5 of FIG. 3 showing the variable mixer in a full mixing position.

Preferably, the movable mixer 102 is of the same general configuration and type as the first mixer 10 but is mounted so as to move, i.e., pivot, from a first non-mixing position as shown in FIG. 6 wherein the plate-like body 112 thereof is positioned so that the fluid stream impinges on the narrow vertically disposed edge 113 thereof and thus, in effect, causes little or no headloss or mixing action to a second fully engaged mixing position as shown in FIG. 5 wherein the body 112 is positioned with the face 115 thereof across the pipe opening such that the peripheral flange 117 thereof and the orifice or central open area 122 are in full contact with the fluid flow. In this second full mixing position, the static mixer exhibits the characteristics of its beta number, that is, if the second mixer is a 0.7 beta, it will exhibit those mixing characteristics. In this way, the system can thus be efficiently utilized for high flow as well as lower flow by regulating the movable mixer to either its non-mixing or mixing positions.

It is also desirable to be able to fix the flange 117 position to partially open positions between the extremes of fully open or fully closed indicated above and through such intermediate flows between high and low can be efficiently accommodated. It is also desirable to sense the flow rate in the pipe upstream of the system and utilize such results to automatically control the opening and closing and partially open positions of the flange 117. Such sensing and control means are well known for other devices in the art.

With respect to the means 130 for pivoting the flange 117, such may comprise of known components such as butterfly valves and include such simple mechanisms as a hand movable handle or knob 132 connected to a rod 134 passing thru the outer plate 136 and, in turn, attached to the flange for rotational movement thereof.

Figure 6A:
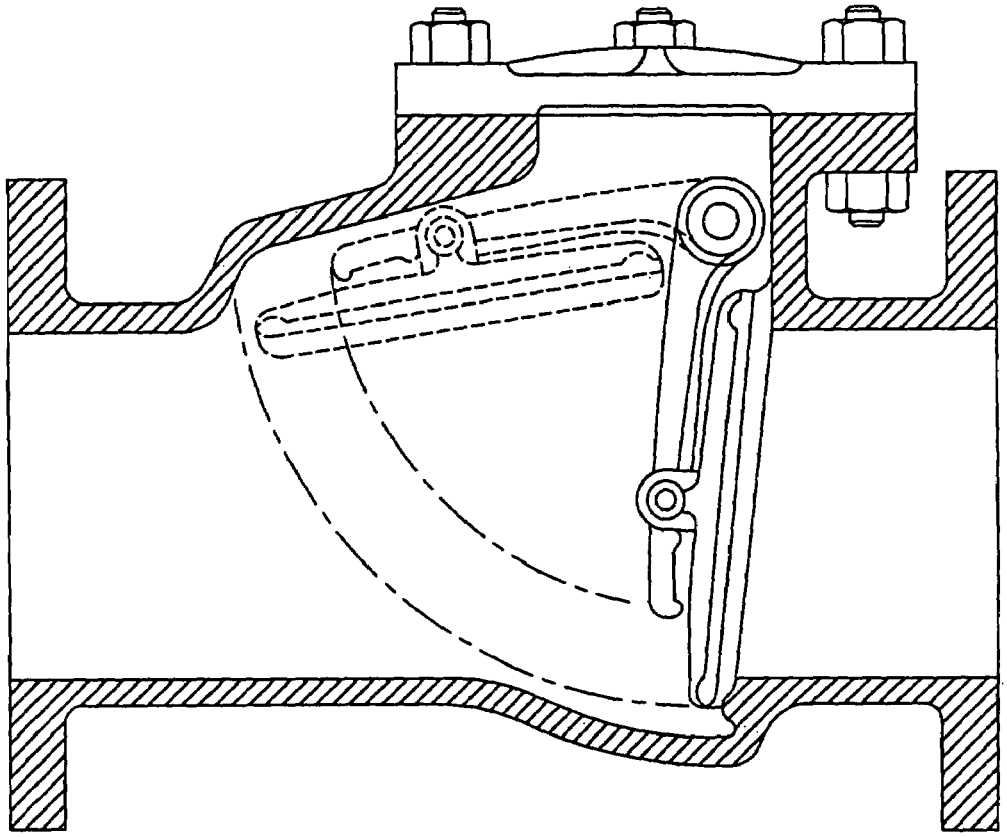
FIG. 6A is an alternate embodiment of the variable position mixer installed in a swing gate check valve.
Figure 6B:
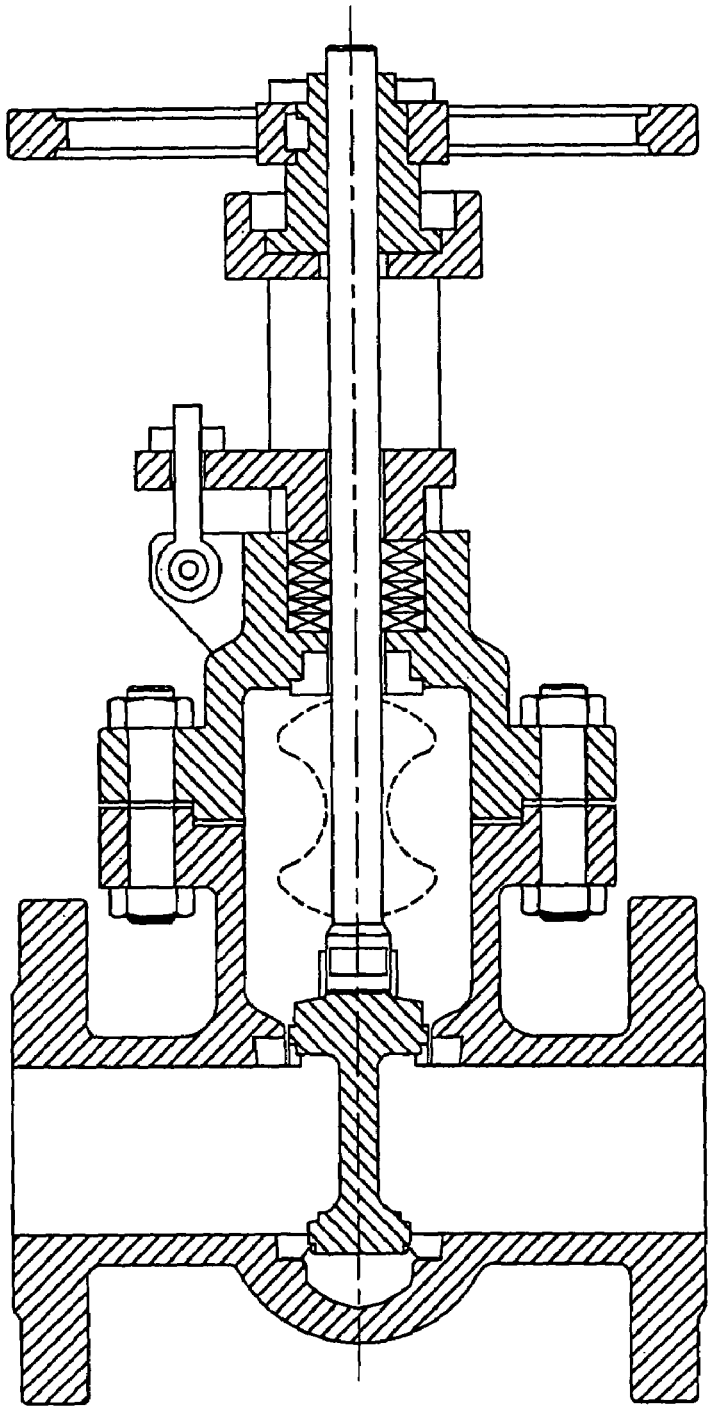
FIG. 6B is another alternate embodiment of the variable position mixer when installed in a gate valve.

Also, the vertical axis of rotation of the butterfly-type valve action of the movable flange 90 degrees in either direction as shown in FIG. 6 could be shifted to the horizontal where the flange edge would be positioned horizontally across the pipe in the non-mixing first position. Additionally, a similarly horizontally positioned flange of the second mixer could be incorporated within a conventional swing gate check valve structure such as shown by FIG. 6A such that the non-mixing position is equivalent to the fully open position of the mixer plate adjacent to the valve body and in such case attached to the operating hinge and the mixing position equivalent to the closed position of the valve across the flow path. The operating hinge mechanism as well as the mixer plate in its non-mixing position can be housed in the upper chamber of the valve. Similarly, a standard gate valve structure as shown in FIG. 6B could support the mixer plate of the movable mixer by attaching such to the operating spindle such that moving the spindle up or down positions the mixer flange either into, out of or partially into the fluid stream.

As above indicated, the preferred form of the invention positions a movable static mixer preferably of a low beta valve downstream from a fixed static mixer usually of a higher beta value; however, it has been found that efficient mixing results can be achieved when a single movable static mixer is placed in the fluid stream, i.e., use of the second movable mixer, without the first fixed static mixer.

It should also be indicated that in those types of static mixers wherein the structure supporting the mixing orifice (or orifices or orifice pattern) is not entirely within the plane defined by the plate surface, e.g., the supporting structure extends outwardly thereof, that the non-mixing position in those situations wherein the plate edge is disposed in line with the fluid flow that portions of the supporting structure may project into the fluid stream and cause some turbulence but with only minimal mixing consequences. Also especially with larger diameter plates, the fixed mixer can be directly mounted such as by welding to the pipeline.

It should be noted that additives can be introduced at other points other than through the pipes or quills and that the material comprising the fluid flow in the pipe could itself compose unmixed feed.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A mixing system for fluid flow flowing in a pipeline comprising; a first static mixer having a plate having a circumferential edge and having a face defining at least one mixing orifice extending therethrough, said first static mixer fixedly positioned in said pipeline with said face surface disposed generally at 90 degrees across the fluid flow in said pipeline; and a second variable position static mixer also having a plate having a face surface defining at least one mixing orifice extending therethrough, said second mixer positioned in said pipeline downstream of said first mixer, the plate of said second mixer mounted for movement between a first generally non-mixing position wherein the plate edge is aligned with the fluid flow and a second mixing position wherein the plate face is aligned with and disposed across the fluid flow direction within said pipeline.

2. The mixing system of claim 1, wherein said second mixer is positioned at least two pipeline diameters downstream of said first mixer.

3. The mixing system of claim 1, wherein said first mixer has a higher beta than said second mixer.

4. The mixing system of claim 1, said second mixer plate adapted to pivot about a radial axis of said pipeline at least 90 degrees between said first and second positions and wherein the diameter of said plate is less than the internal diameter of said pipeline.

5. The mixing system of claim 1, said second mixer plate adapted to pivot about an axis positioned adjacent the internal wall of said pipeline between said first and second positions and wherein said plate edge is disposed adjacent said internal pipeline within said first non-mixing position such as in a check valve construction.

6. The mixing system of claim 1, wherein the second mixer plate is disposed laterally offset from the pipeline internal wall in said first position and is adapted to move into and across said pipeline internal wall in its second mixing position.

7. The mixing system of claim 1, wherein the second mixer plate is fixedly positionable at any intermediate position between said first and second positions.

* * * * *